US008141523B2

(12) United States Patent
Gammons et al.

(10) Patent No.: US 8,141,523 B2
(45) Date of Patent: Mar. 27, 2012

(54) METHOD AND APPARATUS FOR CONTROLLING AN ELECTRIC MOTOR

(75) Inventors: Ricky L. Gammons, Lafayette, TN (US); Zachary A. Henry, Sr., Corryton, TN (US)

(73) Assignee: Petrolfree, Inc., Knoxville, TN (US)

( * ) Notice: Subject to any disclaimer, the term of this patent is extended or adjusted under 35 U.S.C. 154(b) by 630 days.

(21) Appl. No.: 12/203,621

(22) Filed: Sep. 3, 2008

(65) Prior Publication Data

US 2010/0051449 A1 Mar. 4, 2010

(51) Int. Cl.
*F02B 43/08* (2006.01)

(52) U.S. Cl. ..... 123/3; 123/1 A; 210/243

(58) Field of Classification Search ..... 123/1 A, 123/3, DIG. 12, 25 R, 25 E, 536, 538; 429/411, 429/418, 67, 113; 210/243; 204/623, 668, 204/222, 212

See application file for complete search history.

(56) References Cited

U.S. PATENT DOCUMENTS

| | | | | | |
|---|---|---|---|---|---|
| 308,276 | A | | 11/1884 | Paine | |
| 583,104 | A | | 5/1897 | Wattles | |
| 1,262,034 | A | | 4/1918 | Frazer | |
| 1,396,919 | A | * | 11/1921 | Brace | 204/225 |
| 2,145,468 | A | * | 1/1939 | Wangemann | 200/193 |
| 2,548,745 | A | * | 4/1951 | Smith | 338/81 |
| 3,228,863 | A | * | 1/1966 | Wanttaja et al. | 205/642 |
| 3,294,586 | A | * | 12/1966 | Le Duc | 429/405 |
| 3,459,953 | A | * | 8/1969 | Brauser et al. | 290/2 |
| 3,648,668 | A | * | 3/1972 | Pacheco | 123/3 |
| 3,970,070 | A | | 7/1976 | Meyer | |
| 4,111,160 | A | * | 9/1978 | Talenti | 123/1 A |
| 4,112,875 | A | * | 9/1978 | Fletcher et al. | 123/1 A |
| 4,265,224 | A | | 5/1981 | Meyer | |
| 4,275,950 | A | | 6/1981 | Meyer | |
| 4,389,981 | A | | 6/1983 | Meyer | |
| 4,394,230 | A | | 7/1983 | Puharich | |
| 4,421,474 | A | | 12/1983 | Meyer | |
| 4,465,455 | A | | 8/1984 | Meyer | |
| 4,613,304 | A | | 9/1986 | Meyer | |
| 4,613,779 | A | | 9/1986 | Meyer | |
| 4,798,661 | A | | 1/1989 | Meyer | |
| 4,826,581 | A | | 5/1989 | Meyer | |
| 4,936,961 | A | | 6/1990 | Meyer | |
| 5,149,407 | A | | 9/1992 | Meyer | |
| 5,156,114 | A | | 10/1992 | Gunnerman | |
| 5,293,857 | A | | 3/1994 | Meyer | |
| 6,559,566 | B2 | | 5/2003 | Modi et al. | |
| 7,036,616 | B1 | | 5/2006 | Kejha | |

* cited by examiner

*Primary Examiner* — Noah Kamen
*Assistant Examiner* — Hung Q Nguyen
(74) *Attorney, Agent, or Firm* — Pitts & Lake, P.C.

(57) ABSTRACT

Method and apparatus for controlling an electric motor employing an electrolysis subassembly connected in an electrical circuit which includes the electric motor. While controlling the throughput of electrical current through the electrolysis subassembly, there is simultaneously generated a fuel gas useful for fueling an internal combustion engine. The invention includes a novel electrolyte utilizing novel electrode structure and mode of operation. The electrolysis may be powered by a battery pack.

1 Claim, 4 Drawing Sheets

METHOD AND APPARATUS FOR CONTROLLING AN ELECTRIC MOTOR

CROSS-REFERENCE TO RELATED APPLICATIONS

Not Applicable

STATEMENT REGARDING FEDERALLY SPONSORED RESEARCH OR DEVELOPMENT

Not Applicable

FIELD OF INVENTION

This invention relates to methods and apparatus for controlling the operation of an electric motor or an internal combustion engine (ICE). As a beneficial byproduct, there is generated a volume of hydrogen gas suitable for a variety of uses.

BACKGROUND OF INVENTION

Electric motors commonly require means to control the operational speed of the motor(s). For example, in the prior art, control over the speed of rotation of the motor rotor, hence the rotational output of the motor shaft, has taken the form of variable resistors, rheostats, and like devices for adjusting the electrical input employed to drive the motor, such as the input voltage or amperage of the current being fed to the motor. Such prior art devices most commonly generate significant amounts of heat during operation of the motor. They further commonly are limited to specific ranges of electrical input, e.g. between "X" and "Y" volts, "X" and "Y" being chosen, among other things, to provide sufficient power for driving the motor, while minimizing the heat generated by the control device. Such devices are subject to damage by overheating and/or electrical spikes (both high and low) and/or overvoltage or undervoltages.

Electronic motor controllers have been employed. These controllers may exhibit lesser heat problem, but they are most sensitive to damage by electrical spikes and/or overvoltages or undervoltages. In some instances, these devices overheat and have been known to be the source of disastrous fires.

Control of the operation of internal combustion engines (ICEs) is conventionally achieved employing control over the quantity of a stream of combustible gas(es) introduced to the engine by means of a carburetor, for example. Fuel injection also has been employed in similar manner. In each instance, the concept involves feeding of a suitable mixture of air and a combustible gas such as petroleum-based products (gasoline, diesel fuel, etc.) and fuels labeled as biomass fuels, hydrogen, and the like. Alternatively, the prior art has also included the concept of employing electric motors in addition to, or in lieu of, ICEs. Alternative fuel(s) are actively being sought which can reduce the adverse effects on the environment attributable to their use and/or which are less expensive than currently available fuels and/or whose sources are abundantly available and, renewable. Combinations of these fuels and other motor vehicle powering concepts have had only limited success for various reasons such as cost, availability, storage and delivery to consumers, etc.

SUMMARY OF INVENTION

In accordance with one aspect of the present invention there is provided a method and apparatus for controlling motors, either an electric motor, an ICE or both an electric motor and an ICE, in combination, at times simultaneously. The controller of the present invention employs electrolysis of a novel electrolyte utilizing novel electrode structure and mode of operation, thereby producing a novel fuel gas under controlled conditions. Such controlled conditions preferably include the control of that quantity per unit of time of electrical energy throughputted by the electrolysis unit for driving an electric motor or that quantity per unit of time of a gaseous stream generated within the electrolysis for fueling an ICE, for example. That is, in the present invention, there exists the ability to simultaneously control electrical power being fed through an electrolysis unit to an electric motor and a fuel gas for an ICE employing the same source of potential energy.

For present purposes, the term "fuel gas" may include a single gas (e.g. hydrogen) or a mixture of gases (e.g. hydrogen, oxygen, water vapor or steam and/or other chemical entities). Moreover, a fuel gas of the present invention may include minor and/or non-essential components either alone or combined with hydrogen, oxygen or nitrogen, for example. Thus the term "fuel gas" should be understood to include a single gas or a mixture of gases as the context dictates, suggest or implies. Moreover, herein, the term motor may be employed to designate either an electrically powered motor (ac or dc) or an ICE depending upon the context in which the term is used.

As noted, in accordance with the present invention, the novel fuel gas is generated onsite, such as onboard a motor vehicle, or at a site remote from commonly employed sources of power for driving an electric motor, for example.

The electrolysis process of the present invention may be powered by a battery or battery pack in an electrical circuit which includes the motor. The electrodes of the electrolysis unit include first and second, preferably planar, electrically conductive plates, which are electrically connected to collectively define a first electrode. These parallel plates are mounted in registered, spaced-apart, substantially parallel planar relationship to one another within the electrolyte and are adjustable with respect to their spaced apart spatial relationship. There is further included a planar second plate electrode of substantially like size and geometry as the first and second plates of the first electrode. This second electrode is moveable between a first position out of the electrolyte (hence out of register with the plates of the first electrode) and a second position within the electrolyte and partially or substantially fully interposed between the first and second plates, and substantially equidistant from, and aligned (in register) with the first and second plates of the first electrode. According to one aspect of the present invention, the degree of registration of the second electrode with the first and second plates of the first electrode establishes the rate of electrolysis of the electrolyte, hence the control of voltage drop across the electrolysis unit, hence provides for control, in the nature of a variable resistor, over the operation of an electric motor which is electrically connected in an electrical circuit with the electrolysis unit. A stream of fuel gas emanates from the electrolysis unit of the present invention. This fuel gas may be directed to any of several beneficial uses, a principal one of which is to fuel the operation of an ICE.

In accordance with a further aspect of the present invention, the overall energy output from the electric motor has been found to be sufficient to provide a degree of operational energy output from the electric motor to drive a variety of equipment and also to provide sufficient excess energy for charging of the battery pack employed to power the electrolysis unit under useful operational conditions. Still further, as desired, all or a portion of the gaseous output stream from the electrolysis unit may be captured and stored for future use.

DETAILED DESCRIPTION OF INVENTION

Figure 1:
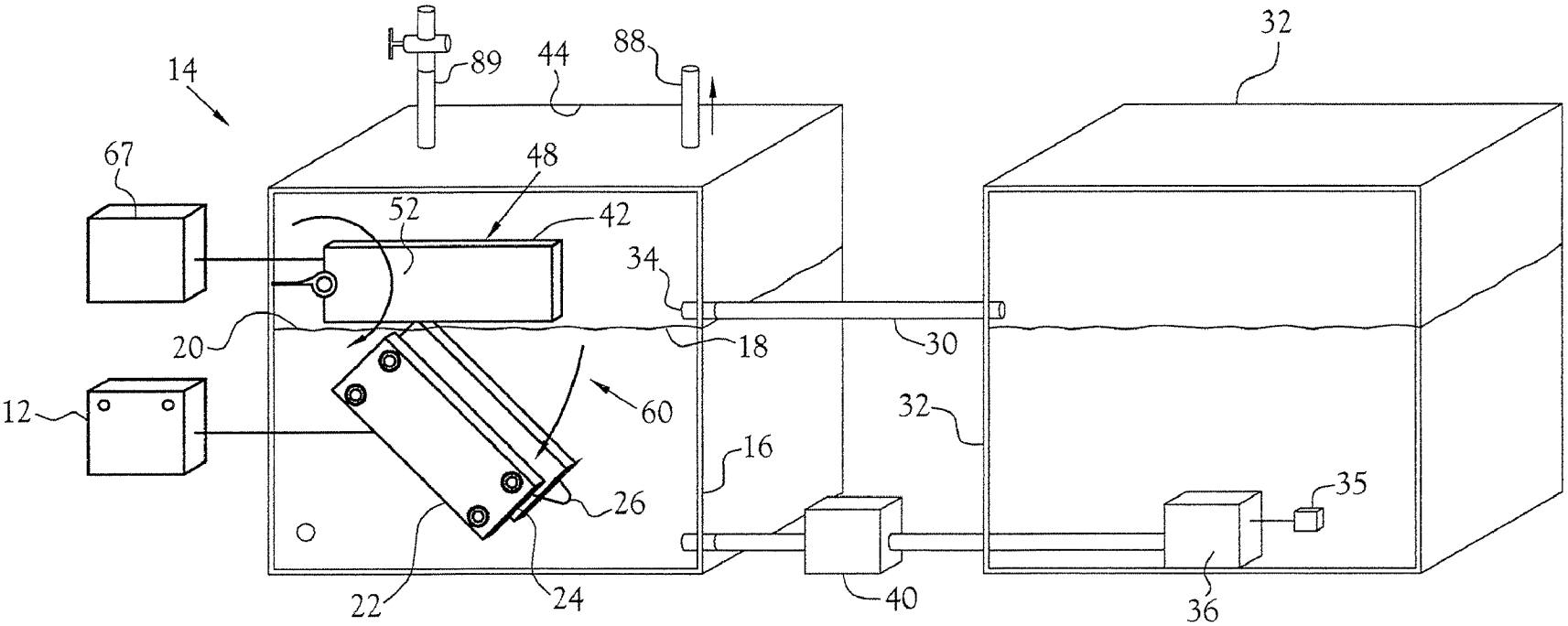
FIG. 1 is a schematic representation of one embodiment of the system of the present invention.

FIG. 1 depicts one embodiment of apparatus useful for carrying out various aspects of the present invention. The depicted apparatus includes a battery pack 12 which serves as a source of electrical energy for powering an electrolysis unit 14. In the embodiment depicted in FIG. 1, the electrolysis unit includes a first tank 16 adapted to contain a quantity of an electrolyte 18. Also contained within the first tank and at a level beneath the upper surface 20 of the electrolyte within the tank, are first and second plates 22 and 24, respectively. Referring to FIGS. 1-4, these two plates are adjustably mounted, by means of bolts 96 within the first tank beneath the upper surface level of the electrolyte disposed within the first tank, for selectively adjusting their spatial relationship. As seen in FIGS. 3 and 4, these plates are disposed in spaced apart, registered, parallel relationship to one another. Further, these two plates are electrically connected to one another as by means of an electrical conductor 26 in a manner which causes these plates to collectively define a single electrode, deemed the first electrode 28 for purposes of the present invention.

The electrolyte-containing first tank 16 is connected in fluid flow communication as by a conduit 30, with a second tank 32 which is adapted to receive and contain a quantity of electrolyte in reserve for selective transfer into and/or through the first tank. In the depicted embodiment, the conduit interconnecting the first and second tanks includes an inlet end 34 which is disposed slightly below the surface level 28 of a desired quantity of electrolyte contained in the first tank. Thus, electrolyte from the first tank will freely flow by gravity from the first tank into the second tank so long as the level of electrolyte in the first tank remains above the level of the input end of the conduit leading to the second tank. For purposes of ensuring controlled flow of electrolyte from the second (reserve) tank into the first tank, there may be provided a thermostat-controlled 35 pump 36 submerged within the electrolyte in the second tank. The output flow of electrolyte from this pump is fed through a conduit 38 to the first tank. Interposed within the length of the conduit, there may be provided a cooling device, such as a radiator 40 capable of cooling the electrolyte flowing from the second tank into the first tank within a selected desired range of temperatures. Power for operation of this pump is provided by the battery pack 12. By this cooling means, heat generated within the electrolysis unit is dissipated via the radiator so that the temperature of the electrolyte within the first tank can be maintained substantially constant at a preselected value or range of values. This factor further serves to maintain the level of effective electrolyte contained within the first tank substantially constant as the electrolyte is depleted over time. Moreover, this same factor enhances the retention of a constant composition of the electrolyte within the first tank, thereby contributing to the generation of an electrical throughput from the electrolysis unit which is substantially constant over time for any given rate of electrolysis of the electrolyte within the first tank.

As further depicted in FIG. 1, there is provided a second electrode 42 mounted within the first tank at a location between opposite side walls 44 and 46, whereby this second electrode is movable between a first position 48 out of the electrolyte disposed within the first tank and a position within the electrolyte within the first tank. This second electrode is desirably of substantially the same geometry and dimensions as each of the first and second plates of the first electrode. In the depicted embodiment, this second electrode is mounted on a shaft 50, for example, located adjacent one end 52 of the second electrode, for movement within a plane which can result in the second electrode being disposed between, spaced substantially equidistantly apart from, and substantially parallel with respect to the planar orientations of, the first and second plates of the first electrode. (See FIG. 3).

As depicted in FIGS. 3 and 4, in one embodiment of the second electrode 42 and its mounting within the first tank and into and out of the electrolyte, the second planar electrode has one end 52 thereof mounted on a stub shaft 50 which is mounted between the opposite side walls 44 and 46 of the first tank at a level sufficiently above the surface level 20 of the electrolyte disposed within the first tank as permits the movement of this second electrode between its first position 48 fully out of the electrolyte and its second position 56 (FIG. 4) of partially or substantially in register with, and between the first and second plates of the first electrode. In the depicted embodiment of FIG. 3, rotation of the stub shaft 50 swings the outboard end 58 of the second electrode along a curved path 60 to move this second electrode between its first and second positions. Rotation of the stub shaft may be effected by any of several means. In FIG. 3, the stub shaft projects through the wall 44 of the first tank and beyond the outer surface of the wall. That portion of the stub shaft which projects beyond the outer surface of the tank wall includes a lever arm 64 attached thereto, the movement of which may effect rotation of the second electrode as desired. By means of the adjustability of the spacing between the first and second plates of the first electrode, a substantially unlimited electrical resistance range with unlimited voltage drop within the range of the battery pack may be achieved employing the present electrolysis unit.

From the foregoing, it will be recognized that movement of the second electrode into the electrolyte and between the first and second plates of the first electrode establishes a variable resistance path for the movement of ions and electrons causing a flow of electrical current between the first and second plates of the first electrode and the second electrode with resultant controlled flow of an electrical current within an external circuit that includes an electric motor.

Figure 2:
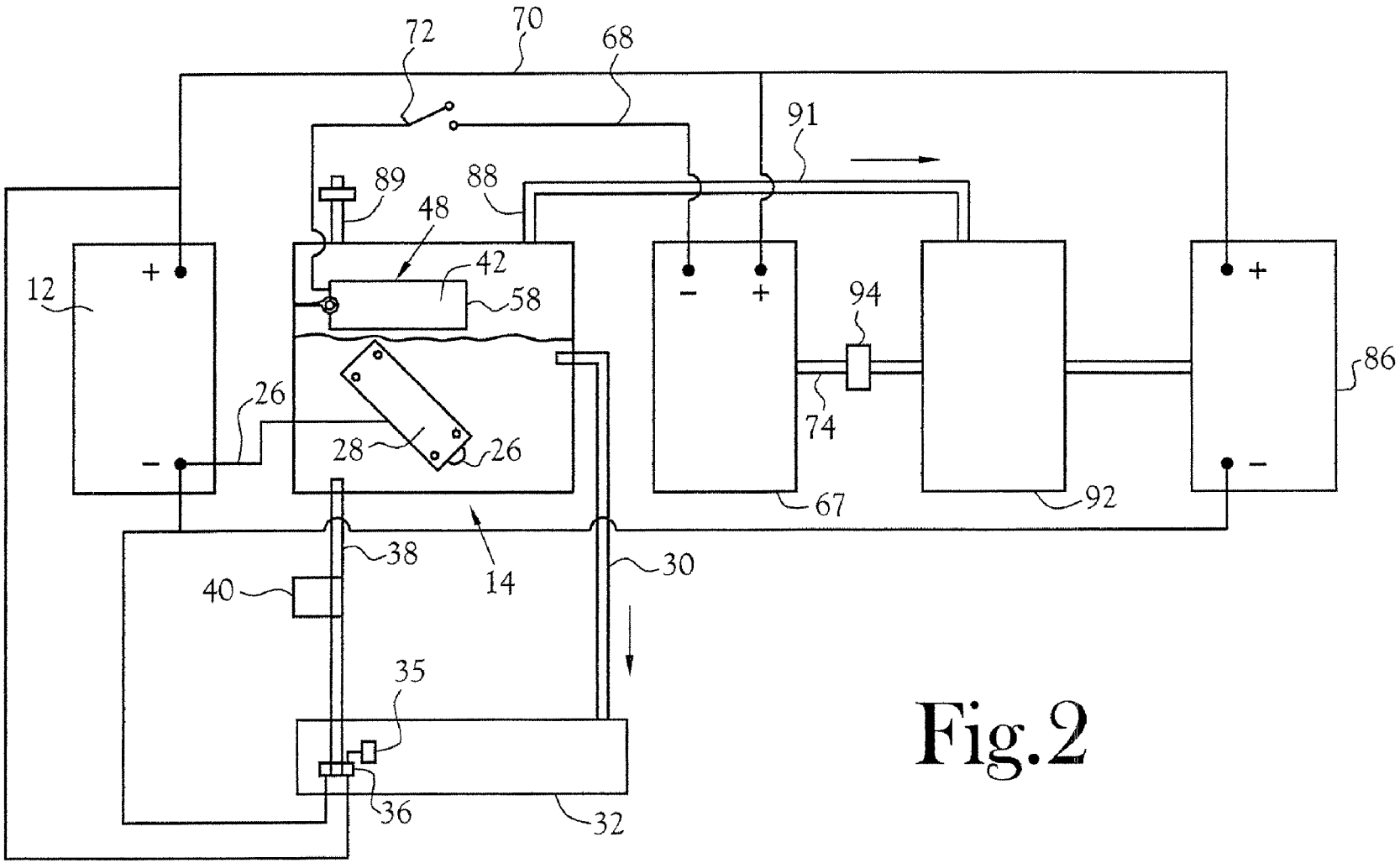
FIG. 2 is further schematic representation of the system of FIG. 1 and including a diagrammatic representation of one embodiment of electrical circuitry, among other features, associated with the system depicted in FIG. 1.
Figure 3:
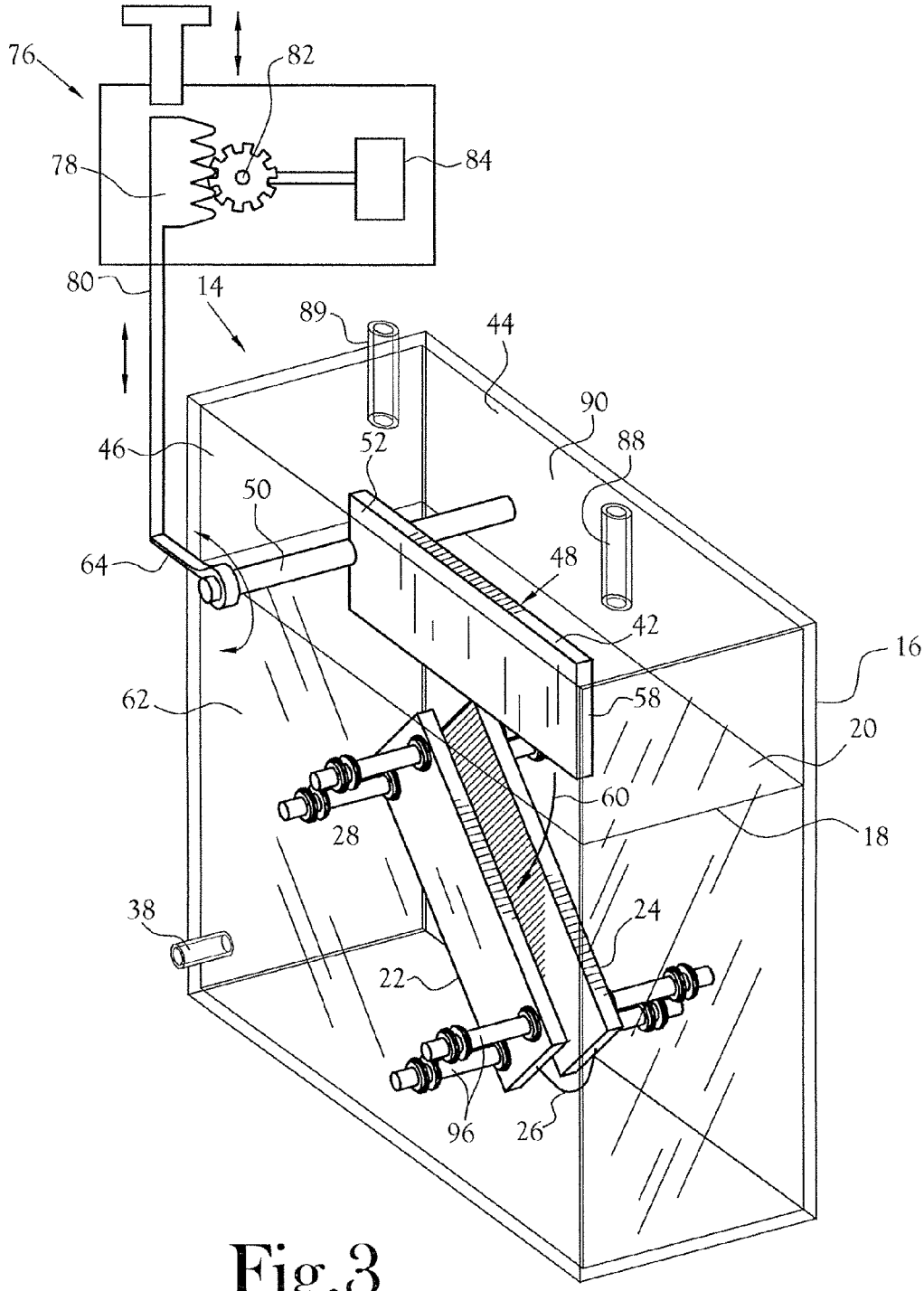
FIG. 3 is a perspective schematic representation of one embodiment of an electrolysis unit useful in the present invention.
Figure 4:
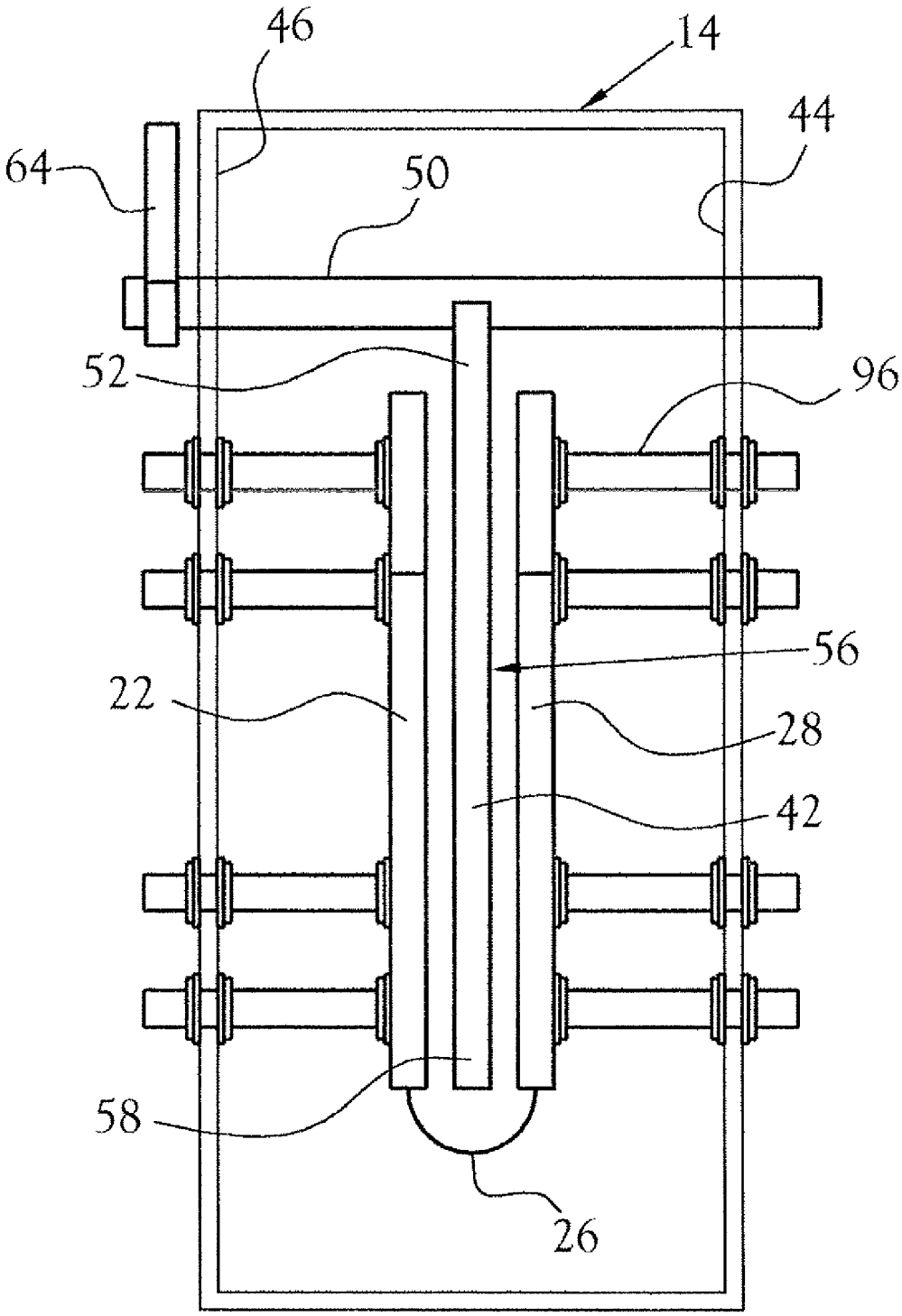
FIG. 4 is an end plan view of an electrolysis unit as depicted in FIG. 3.

More specifically, with reference to FIGS. 2-4, in one embodiment of the present invention, electrolysis of an electrolyte takes place within the first tank 16. Within this tank there is provided an electrolyte 18. The first and second plates of the first electrode are fixedly mounted between the opposite side walls of the tank in spaced apart, in register, relationship to one another. The spacing between these plates is chosen to be sufficient to permit the free movement of the second electrode between the parallel planes first and second plates in a plane substantially parallel to the planes occupied by these plates. As noted the second electrode is mounted to be positioned either fully outside the volume of electrolyte within the tank or positioned within the electrolyte within the tank and either partially or substantially fully between the plates of the first electrode. When the second electrode is disposed fully outside the volume of electrolyte, no electrolytic action takes place within the first tank.

As depicted, the first electrode is electrically connected to the negative post of a battery pack 12 by an electrical conductor 66 and the second electrode is connected to the negative post of an electric motor 67 as by an electrical conductor 68. The positive post of the electric motor is electrically connected to the positive post of the battery pack as by an electrical conductor to define an electrical circuit which contains components disposed externally of the tank. A switch 72 may be interposed in the electrical conductor 70 to open and close the aforesaid external electrical circuit.

As noted, when the second electrolysis electrode is disposed outside the electrolyte within the first tank, no electrolytic action takes place within the first tank and no electrical current flows to the electric motor. Upon rotation of the second electrode into the volume of electrolyte within the tank and into proximity to the first electrode, electrolysis commences within the tank. When the switch is closed, the electrical current from the battery pack flows through the external circuit including the electric motor, causing the motor to function. As is well known in the art, the output shaft 74 of the electric motor may be connected to and provide motive power to any of a very large number and variety of devices, apparatus, etc. Further, it will be noted that as the second electrode is moved toward a position of substantial registration of the second electrode with the first and second plates of the first electrode, the electrical resistance between the first and second electrodes decreases thereby increasing the rate of electrolytic action and resultant increase in the electrical current throughput of the electrolysis unit.

Control over the physical position of the second electrode 42 relative to the space between the first and second plates of the first electrode may be accomplished by any of several means. In FIG. 3, rotation of the mounting shaft 50 of the second electrode is employed to rotate the second electrode into and/or out of the volume of electrolyte disposed within the tank. In the depicted embodiment, there is provided a lever arm 64 fixedly secured to the mounting shaft for the second electrode. Rotational movement of this lever effects rotation of the mounting shaft, hence movement of the second electrode into and out of the volume of electrolyte disposed within the tank. In one embodiment, the operation of the lever may be effected by means of a rack and pinion gear set 76, the rack 78 of which is mechanically connected to the outboard end of the lever as by a connecting rod 80. Movement of the rack may be carried out by physically moving the rack up or down as seen in phantom in FIG. 3, or by driving the movement of the rack via the pinion gear 82 driven by a battery pack-powered motor 84 or other power source. In any event, operation of the lever establishes the degree of submersion of the second electrode into the electrolyte, hence the rate of electrolysis taking place within the tank, hence the amount of the current throughput of the electrolysis unit.

Through the management of the amount of current throughput of the electrolysis unit, there is management of the amount of current being fed to the electric motor, hence the speed at which the electric motor will operate. Various electrical components may be interposed within the external circuit to influence the system and the current flowing through the external circuit. For example, as depicted in FIG. 2, a generator/alternator 86 that is driven by a belt from the main shaft of the power plant generates a charging current to be fed to the battery pack 12. As necessary, over time, the battery pack 12 may be recharged employing an external power source.

As also depicted in FIGS. 2 and 3, the level 20 of electrolyte 18 within the first tank is maintained substantially constant. To this end, the first tank is provided with a conduit 30 which is connected in fluid flow communication with the reserve (second) tank 32. Initially, the second tank is provided with a selected maximum volume of the same electrolyte as is disposed within the first tank. Over time, through depletion of the electrolyte with in the first tank, replenishment electrolyte disposed within the second tank is transferred from the reserve tank to the first tank. To this end, there may be provided a pump 36 submerged within the electrolyte within the reserve tank and having its output connected in fluid flow communication with the electrolyte disposed within the first tank, as by conduit 38. Operation of the electrolysis apparatus generates heat which may raise the temperature of the electrolyte disposed within the first tank above an optimum operating temperature, for example an operating temperature of between about 120 and about 160 degrees, preferably about 150 degrees, Fahrenheit. Regulation of the temperature of the electrolyte disposed within the first tank may be by means of a cooling device, e.g. a radiator, interposed along the length of the conduit leading from the pump to the first tank. Other temperature control means may be employed as desired. Air intake to the first tank is provided by a valved air vent 89 mounted in the top 90 of the first tank.

In addition to dividing the voltage of the external electric circuit, the electrolysis unit generates a substantial volume of gas (es), principally hydrogen, oxygen and water vapor or steam, ("fuel gas") in the course of the electrolysis process. The first tank is a closed vessel so that if no use of this fuel gas is desired or needed, it may be vented to the ambient atmosphere as by way of a vent tube 88 disposed in the top end of the first tank. However, desirably, the fuel gas generated in the electrolysis unit is directed to some device or system wherein it can serve a useful purpose. To this end, as depicted in FIG. 2, the present inventors have found that such fuel gas may be fed from the first tank, as by a conduit 96, and employed as the sole fuel for the operation of an internal combustion engine 92 when mixed with a proper volume of air. For example, a combination of a portable ICE powered by the fuel gas from an electrolysis unit as disclosed herein is useful as a source of mechanical power for driving a grain transfer conveyor to a silo located out of reach of a source of electrical power for driving the conveyor.

In one specific example of the present invention, there was provided an electrolysis unit comprising a first tank which was 18 inches high, 4 inches wide and 18 inches deep. Approximately 4 gallons of electrolyte was disposed within this first tank. First and second plates of cold rolled steel served as the first and second plates of the first electrode. Each of these plates was 12 inches long, 4 inches wide and 0.5 inches thick. Each of these plates was mounted to their respective side wall of the first tank as by means of adjustable bolts 96 (typical). These plates occupied substantially parallel planes and were spaced apart and in substantially full register with one another. The spacing between the plates was adjusted to between about 0.75 inch and about 1.0 inch. The second electrode was of like size, geometry and composition as one of the plates of the first electrode. Thus, when the second electrode was disposed in the space between the first and second plates of the first electrode, there was defined an available ion and electron flow path between the first and second electrodes of about 0.125 inch on either of the opposite sides of the second electrode. Employing a 48 volt battery pack, through the mechanism of adjusting the spatial relationship of the first and second electrodes to provide more or less registration of these electrodes, plus more or less immersion of the second electrode within the electrolyte, the rate of progression of the electrolysis taking place within the first tank of this example was adjusted to produce an electrical current output of between about 100 amperes and about 800 amperes. Adjustment of this unit allows it to handle up to 3000 amperes. A similar unit of larger construction may be expected to handle amperages up to 8000 amperes. At any given level of throughput within this range of throughputs, the electrical throughput from the electrolysis unit was substantially constant.

Whereas the composition of the electrolyte employed in the present invention may vary, in the present example, the electrolyte included one pound of common table salt, two fluid ounces of turpentine, and one quart of denatured ethyl alcohol per each 20 gallons of water. Variations in the relative amounts of each of the listed ingredients of the electrolyte employed as well as the addition of other additives to the water and salt mixture were also found useable. The above example has proven to be more than adequate for the production of sufficient fuel gas to successfully provide sustained operation of a 5 hp electric motor and an internal combustion engine of between about 250 cc displacement to about 5700 cc displacement in a system employing the present motor control for adjustment of the electric motor operation and the provision of fuel gas for fueling the operation of the ICE. In this example, after the electric motor was employed to start the ICE and sustain such operation until sufficient fuel gas was being produced for sustaining the operation of the ICE (usually less than about 15 seconds), the electric motor was dropped out of the system and the ICE continued to operate and provide strong power output for extended periods of time, e.g. for several hours, under load. In this example, the reserve tank contained 20 gallons of electrolyte which was pumped by the electrically-driven pump 35, between the first and second tanks at the rate of about 2.5 gal/min. This operation of the pump was controlled by a thermostat and the flow rate varied as needed to maintain the temperature of the electrolyte in the first tank at about 150 degrees Fahrenheit.

It will be noted that in the prior art electronic controllers there must be provided one controller for each motor when operating multiple motors unless the motors are connected in series. When so connected in series, there exists the problem that when one of the motors loses its load (such as one of the wheels of a vehicle losing its traction), all of the current is directed to this motor to the exclusion of current to the other three motors, making serial connection of multiple motors most undesirable. Contrariwise, in the present invention, when employing multiple motors, only one controller may be employed when the motors are connected in parallel. In this arrangement, when power to one of the motors is lost, that power which previously was flowing to the now defunct motor shifts to the remaining ones of the multiple motors so long as these remaining motors remain under load.

Further, whereas electronic controllers of the prior art commonly operate within the range of 800 to 1000 amps, the present controller successfully operates within the range of 2400 to 3000 amps. Within the present electrolysis unit, arcing resulting from over-voltages is substantially immaterial, in that the present controller can absorb such over-voltages without material damage to the electrodes of the electrolysis unit.

Additionally, in contrast to the prior art controllers for permanent magnet motors which employ a "chopping" concept, the present invention may be employed to control permanent magnet motors with a substantially constant electrical input to the motor in that the present controller does not produce a "pulsed" throughput.

In a further example, 4 gallons of electrolyte as described hereinabove was loaded into a single tank 16 inches high, 18 inches long and 4 inches wide. The first and second electrodes were electrically connected to a 48 volt battery pack. With no variable voltage provision, the fuel gas output from the electrolysis unit was sufficient to provide the sole source of fuel to successfully operate a 262 cc, 2-cylinder, 4-cycle, overhead valve internal combustion engine for more than 10 hours of continuous operation. In this example, no electric motor was incorporated in the circuit so that the engine was hand-cranked to start the same.

Employing a system as depicted in FIGS. 2-4, when the system is started, the level of electrical activity within the electric motor controller/fuel gas generator of the present invention is used to control the operational speed of the electric motor. This electric motor was connected to the ICE through a mechanical coupling, thereby providing starting energy to the ICE. The intake suction of the ICE drew fuel gas from the electrolysis unit to commence operation of the ICE which then took the place of being the primary source of throughput power for the system, as supplemented as needed by the power from the electric motor. An alternator was coupled to the power train of the electric motor or ICE. One 12-volt alternator with a rating of 100 amps was provided for each 12 volts of the battery pack. The batteries of this system recharged as the power plant was operated. This was found to be especially effective during idling periods and during other periods when the power plant had less than a full load. The coupling between the electric motor and the ICE was provided with an electric clutch to isolate the electric motor from the ICE as desired.

The following tests were conducted employing various of the concepts of the present invention.

Test #1

Referring to FIG. 5 the features of the present invention were embodied in a test vehicle. This test apparatus included:

a) 3340 lb minivan having 10 inch diameter wheels, a 262 cc displacement, 2-cylinder, air cooled, overhead valve engine originally adapted to be fueled by conventional gasoline fed to the engine through a conventional carburetor, and an output power shaft from which the power was transferred to the rear wheels of the minivan through belts, b) a 96 volt battery pack disposed wholly within the minivan, c) a conventional alternating current generator with an output of 120 volts at a continuous rating of 7500 watts and with a separate battery charging system from the generator to the battery pack and operatively connected to the drive shaft of the engine, d) a fuel gas/motor controller unit mounted wholly within the minivan, this unit including an electrolysis subassembly containing an electrolyte mixture of the present invention, a stationary dual-plate electrode disposed within the electrolyte, a moveably electrode mounted for movement into and out of the electrolyte and adjustment of the physical spatial relationship between the stationary and moveable electrode, e) A 5 hp direct current electric motor that is in the electrical circuit with the battery and the electrolysis unit, and is in a mechanically operative relationship with the main shaft of the ICE, f) an electrical lead connecting the moveable electrode to the positive terminal of the electric motor, g) an electrical lead connecting the negative terminal of the electric motor to the positive post of the battery pack, h) an electrical lead connecting the negative post of the battery pack to the stationary electrode of the electrolysis subassembly, and i) a fuel gas feed line connecting the output vent of the electrolysis subassembly to the carburetor of the engine.

The foregoing described test apparatus was operated as follows:

a) The system startup included partial movement of the movable electrode of the electric motor controller/fuel gas generator into the electrolyte. The electrolysis began to produce the fuel gas and permitted an electrical current to be fed from the battery pack to the 5 hp electric motor, causing this motor to commence operation. By reason of the physical interconnection of the electric motor and the ICE, the ICE commenced cycling. The effluent fuel gas from the electric motor controller/fuel gas generation was pulled into the carburetor of the ICE and the ICE began to operate. This "startup" process consumed about 28 seconds. Multiple testing has shown that this startup time may vary with the operating conditions of the overall system and particularly the operating temperature of the electrolyte. For example, at temperatures above about 160 degrees F., the ICE loses some of its efficiency, and, b) Following startup of the ICE using solely the fuel gas generated within the electrolysis subassembly, (no other fuel was onboard the vehicle) the vehicle was driven out of the shop under its own power to a nearby road. On the road, the vehicle was driven 4.2 miles at approximately 20 mph without changing the gear ratio from the ICE to the rear wheels.

Prior to the startup, the battery pack voltage was 97 volts. This voltage dropped to 91 volts at the time the ICE started, but rose to and held at 107 volts during the test run of the ICE. At the end of the test run of the ICE, the battery pack voltage was 97 volts, thereby indicating the ability of the ac generator to recharge the battery pack during the over-the-road operation of the vehicle.

Test #2

Employing the same apparatus as described in Test #1 above, the ICE was powered and employed in a test run on a road for 8.4 miles at an average speed of 20 mph. The maximum temperature of the electrolyte was 207 degrees F., indicating the need to maintain the temperature of the electrolyte at a lower temperature. At the beginning of this test, the battery pack was at 101 volts and at the end of the run, this voltage was also at 101 volts.

Test #3

A further test was conducted employing the method and apparatus described in Test #1 except one change was made. In this Test #3, the 5 hp electric motor was excluded from the overall system. Thus, the only component in the electrical circuit was the fuel gas generator. The power plant for the vehicle, therefore, was driven solely by the ICE which, in turn, was solely fueled by the fuel gas generated by the electrolysis subassembly.

In this test, the ICE was started by physically pushing the vehicle after allowing time for adequate fuel gas to be generated.

The length of this test run was 0.7 miles on a road. Throughout this test, the ICE powered the vehicle very well.

Throughout this test, the temperature of the electrolyte remained at approximately 135 degrees F. This reduction in temperature of the electrolyte during this test over the temperature of the electrolyte during Test #2 was attributed to the absence of the electric motor in the system so that the required rate of electrolysis was less than in Test #2. At this lower temperature, there was found to be sufficient fuel gas generation as needed to fuel the ICE.

In this Test #3, at the commencement of the test, the battery pack voltage was 107 volts. At the end of the test, the battery pack also indicated a voltage of 107 volts.

Test #4

This test was conducted within the shop. Employing the method and apparatus described in Test #1 above, the ICE was started (with the 5 hp electric motor in the circuit). In this test, when the ICE commenced operating, the 5 hp de electric motor was switched out of the circuit and the motor controller/fuel gas generator was switched into a 120 volt alternating circuit from the generator as described in Test #1. That is, the power for operation of the electrolysis subassembly was derived solely from the 120 volt ac current from the generator, as opposed to power from the battery pack. Under these conditions, the ICE was operated continuously for 2.75 hours. During this test, it was found that an electrolyte temperature of between about 135 degrees F. and about 160 degrees F. appeared to be most acceptable. In this test, above about 160 degrees F. the ICE lost some of its efficiency.

At the commencement of operation of the ICE of Test #4, the battery pack voltage was 73 volts. When the ICE was stopped after 2.75 hours of operation, the battery pack voltage was 101.5 volts.

Test #5

In Test #4, it was observed that possibly excess water spray was being conveyed to the ICE carburetor in the fuel gas stream. The overall system as described in Test #1 was modified by the incorporation into the system of a water spray "trap" intermediate to the fuel gas generator and the engine carburetor. This trap comprised a 4 inch diameter PVC outer tube within which there was mounted an aluminum tube having holes drilled through its thickness along a top side thereof. In this apparatus, the fuel gas stream from the electrolysis subassembly was fed into one end of the PVC pipe whereupon the lighter gas(es) in the fuel gas stream rose to the top of the outer tube and were drawn into the inner aluminum tube through the holes drilled in the top side of the aluminum tube, thence on to the ICE carburetor. The heavier gas(es), and especially the water content of the fuel gas stream from the generator, which were extracted out of the fuel gas stream were discharged from the PVC tube to ambient environment. Regulation of the mixture of air and fuel gas to the ICE carburetor was accomplished by placement of a butterfly valve in the "entrance" end of the aluminum tube which was mounted within the PVC pipe.

This modification appeared to enhance the operation of the ICE.

Test #6

From earlier tests, it appeared that even though the operating temperature of the electrolyte should be maintained between about 135 degrees F. and about 160 degrees F., the ICE operation was enhanced when the temperature of the fuel gas/air mixture fed into the ICE carburetor was at a higher temperature within this range. Especially, spark ignition within the ICE of the fuel gas/air mixture from the carburetor appeared to be more effective, producing enhanced throughput power and smoother operation of the ICE.

Accordingly, the system described in Test #1 was modified to add a heat exchanger intermediate to the motor controller/fuel gas subassembly and the intake manifold of the ICE. In one embodiment, this heat exchanger comprised coiling the tubular feed line of the fuel gas to the carburetor around the exhaust manifold of the ICE so that the fuel gas being fed to the intake manifold was heated to a higher temperature than the temperature of the fuel gas exiting the motor controller/fuel gas generator subassembly. Whereas this embodiment was expedient for the test, it will be recognized that an independent heat exchanger of conventional design may be substituted for the coiling of the fuel gas feed line about the exhaust manifold of the ICE. Moreover, such an independent heat exchanger would provide better control, including consistency, over the exact temperature of the fuel gas stream entering the carburetor.

Test #7

A 1995, 5.7 liter, Chevrolet Tahoe engine with a single 12 volt standard battery and a standard 110 amp alternator to recharge the battery was used for this test. A 120 volt alternating current inverter that converted 12 volt direct current from the battery to 120 volt alternating current with a maximum continuous operating rating of 2000 watts was used to supply energy for the electrolysis. The electricity to the electrolysis unit was controlled by a 2000 ampere maximum rated rheostat. A small electrolysis unit was used that was contained in an 8 inch high by 3.5 inch diameter glass vessel. The electrodes were 0.25 inch iron rods inserted from the top of the vessel. The distance between the electrodes was not variable. A heat exchanger was used, as described in Test #6 to pre-heat the fuel gas before it entered the intake manifold. The fuel gas produced was not enough to totally power the vehicle but was used in combination with gasoline. A 500 mile trip was made with the system. The battery maintained a charge level equal to or above the 12 volt level. The same 500 mile trip, on several previous occasions in the Tahoe vehicle of this test, had required more than 30 gallons of gasoline. This test trip required only approximately 10 gallons of gasoline and approximately 7 gallons of electrolyte mixture. In each of the tests recorded hereinabove, the output of fuel gas from the motor controller/fuel gas generator was regulated to produce that volume of fuel gas necessary to operate the ICE at a desired rpm, much in the nature of the function of the accelerator of a conventional motor vehicle equipped with an ICE.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific detail, representative apparatus and methods, and illustrative examples shown and described. Accordingly, departures may be made from such details without departing from the spirit or scope of applicant's general inventive concept.

What is claimed is:

1. A controller for an electric motor comprising an electrolysis unit including:

a tank for containing an electrolyte, a quantity of electrolyte disposed within said tank, a first electrode disposed within said electrolyte in said tank, wherein said first electrode comprises first and second plates spaced apart from one another and occupying substantially parallel planes, said first and second plates being electrically connected whereby said first and second plates collectively constitute said first electrode; and a second electrode moveable between a first position outside said electrolyte in said tank and a second position at least partially within said electrolyte in said tank and adjacent said first electrode disposed within said electrolyte in said tank, said electrolysis unit being configured to establish an electrical current between said first and second electrodes when said second electrode is in said second position, said electrical current being directed to power an electric motor.

* * * * *